US005647438A

United States Patent [19]

Chatrathi et al.

[11] Patent Number: 5,647,438

[45] Date of Patent: Jul. 15, 1997

[54] EXPLOSION SUPPRESSANT DISPERSION NOZZLE

[75] Inventors: Srikrishna Chatrathi, Lee's Summit; William A. Staggs, Kansas City; Anthony J. Lombardo, Independence, all of Mo.

[73] Assignee: Fike Corporation, Blue Springs, Mo.

[21] Appl. No.: 638,972

[22] Filed: Apr. 25, 1996

[51] Int. Cl.[6] ..... A62C 35/08

[52] U.S. Cl. ..... 169/58; 169/28; 169/37

[58] Field of Search ..... 169/58, 26, 28, 169/37, 38, 39, 40, 41

[56] References Cited

U.S. PATENT DOCUMENTS

| | | | |
|---|---|---|---|
| 4,213,567 | 7/1989 | McIntire . | |
| 4,328,867 | 5/1982 | Heath | 169/58 |
| 4,351,393 | 9/1982 | Tyree . | |
| 4,739,835 | 4/1988 | Polan et al. | 169/38 |
| 5,031,701 | 7/1991 | McLelland et al. . | |
| 5,199,500 | 4/1993 | Norman et al. . | |

FOREIGN PATENT DOCUMENTS

| | | | |
|---|---|---|---|
| 454109 | 1/1949 | Canada | 169/40 |
| 2613091 | 10/1976 | Germany | 169/37 |

*Primary Examiner*—Gary C. Hoge

*Attorney, Agent, or Firm*—Hovey, Williams, Timmons & Collins

[57] ABSTRACT

An explosion suppressant dispersion nozzle 10 for dispersing suppressant material from a pressurized suppressant storage vessel 12 to a protected zone or room is disclosed. The nozzle 10 includes a cylindrical body section 20 presenting an inlet end 26 for attachment to the storage vessel 12 and a discharge end 28, and a concavo-convex cap section 24 attached to the discharge end 28. The body section 20 includes a plurality of circumferentially spaced windows 32 each presenting generally rectangular openings for dispersing suppressant material laterally from the nozzle 10. The cap section 24 includes a central orifice 48 aligned with the longitudinal axis of the nozzle 10 for dispersing suppressant material axially from the nozzle 10 and a plurality of circumferentially spaced holes 50 spaced radially from the central orifice 48 for dispersing suppressant material radially from the nozzle 10. The windows 32, central orifice 48, and holes 50 are cooperatively positioned and sized for achieving a nearly hemispherical discharge pattern from the nozzle 10 with little loss of dispersion velocity.

20 Claims, 2 Drawing Sheets

EXPLOSION SUPPRESSANT DISPERSION NOZZLE

BACKGROUND OF THE INVENTION

1. Field of the Invention

The present invention relates generally to the field of explosion protection systems, and more particularly to an explosion suppressant dispersion nozzle for connection to a pressurized suppressant vessel for discharging suppressant material to a protected zone or room.

2. Description of the Prior Art

Many industrial and commercial areas are equipped with explosion protection systems for preventing and extinguishing explosions in protected zones or rooms. These explosion protection systems are typically designed to insure a nearly simultaneous release of explosion suppressant material into the protected zones from several spaced locations to quickly prevent or extinguish an explosion.

As alluded to in U.S. Pat. No. 5,031,701, which is incorporated herein by reference thereto, the mechanics of delivering an effective amount of a suppressant to an incipient explosion and in a uniform dispersion pattern has lagged behind the technology of detecting the onset of an explosion as a function of pressure rise in a protected zone. Pressure detection techniques are now so sensitive that detectors are capable of responding to sudden or increase in pressure in only a few milliseconds. However, in order to suppress an explosion before the pressure rise starts to increase along the vertical portion of the exponential curve, suppressant must be uniformly delivered to the threatened area during the initial, flatter part of the pressure rise curve.

One type of prior art explosion protection system includes a plurality of pressurized suppressant storage vessels spaced throughout a protected zone. Each storage vessel includes a rupture disc disposed across the discharge end of the storage vessel for sealing the pressurized suppressant material in the storage vessel, a sensor and control device for sensing the presence of an incipient explosion in the protected zone, an initiator or detonator responsive to the sensor and control device for rupturing the rupture disc in response to the detection of an incipient explosion, and a nozzle for dispersing the suppressant material throughout the protected zone.

The nozzles on these prior art explosion protection systems typically include a plurality of orifices, holes and/or windows for discharging suppressant from all sides of the nozzle. However, prior art nozzles are not optimally designed to disperse suppressant material throughout a protected zone in the most efficient and effective manner.

For example, it is advantageous for an explosion suppression dispersion nozzle to discharge suppressant in a hemispherical pattern so that substantially equal amounts of the suppressant reaches all points equidistant from the nozzle at essentially the same time. This allows for the most effective suppression of an explosion no matter where it occurs in the protected zone while also permitting the most efficient placement of the nozzles.

Prior art nozzles have not in fact been of optimal design for achieving a preferred hemispherical discharge pattern because the orifices, holes and/or windows that have been provided did not cooperate in the most efficient manner to assure substantially unimpeded, rapid delivery of suppressant while at the same time providing a desired hemispherical suppressant pattern at the protected site. FIG. 3 of the drawings appended hereto illustrates the discharge pattern of a typical prior art explosion suppressant discharge nozzle. As illustrated, a larger proportion of the suppressant is discharged from the tip and immediate sides of the nozzle than is discharged in the zones between the tip and sides of the nozzle. Therefore, the resultant non-uniform discharge pattern is not as effective as desired in suppressing explosions that originate in the area that has been assigned to be protected by a respective explosion protection unit.

It is also advantageous to achieve a desired discharge pattern without excessively diminishing the discharge rate of the suppressant out of the nozzle. For example, a perfectly hemispherical discharge pattern is not as beneficial if the discharge velocity of the suppressant is so low that the suppressant is not rapidly and uniformly delivered to protected points remote from the nozzle.

Prior art explosion suppression dispersion nozzles do not achieve a high discharge rate because the nozzles include orifices, holes, and/or windows having edges that extend nearly perpendicular to the longitudinal axis of the nozzle. These edges interfere with the flow of suppressant out of the nozzle and thus reduce the discharge rate of the suppressant. This of course reduces the effective discharge range of the nozzle. As illustrated in FIG. 3, these edges cause suppressant material to be discharged a long distance from the nozzle at certain points and only a short distant at other points. Again, this results in a non-hemispherical discharge pattern that is not as efficient in suppressing an explosion than would be the case in a more hemispherical suppressant pattern.

Since prior art dispersion nozzles have not achieved optimal suppressant discharge patterns while maintaining high discharge rates, it has been difficult to determine where the suppressant units should be positioned relative to one another to adequately protect a selected area. To remedy these deficiencies, it has been the practice to equip explosion protection systems with a sufficient number of individual suppressant delivery units to provide adequate overlapping of discharge patterns from adjacent units. It can be readily appreciated that adding extra, overlapping storage vessels and nozzles needlessly increases the costs of an explosion protection system.

OBJECTS AND SUMMARY OF THE INVENTION

In view of the foregoing inherent design and operating limitations of prior art explosion suppressant dispersion nozzles, it is an object of the present invention to provide an improved explosion suppression dispersion nozzle that more effectively achieves an optimal discharge pattern of suppressant which is delivered to a protected zone.

It is a more particular object of the present invention to provide a dispersion nozzle that disperses suppressant into a protected zone in a nearly hemispherical discharge pattern.

It is another object of the present invention to provide a dispersion nozzle that achieves an optimal discharge pattern without excessively disrupting the flow rate of the suppressant out of the nozzle.

In view of these objects and other objects that become evident from the description of a preferred embodiment of the invention herein, an improved explosion suppressant dispersion nozzle for use with an explosion protection system is provided. The explosion suppressant dispersion nozzle broadly includes a cylindrical body section presenting an inlet end for attachment to a pressurized suppressant storage vessel and a discharge end, and a concavo-convex cap section attached to the discharge end.

The body section includes a plurality of circumferentially spaced windows for dispersing suppressant material laterally from the longitudinal axis of the nozzle. Each of the windows presents a first end wall proximate the inlet end of the body section and a second end wall axially spaced from the first end wall and proximate the discharge end. Advantageously, each of the second end walls is semi-cylindrical in configuration and generally coaxial with the body section for reducing the flow resistance of the open windows.

The cap section includes a central orifice aligned with the longitudinal axis of the nozzle for dispersing suppressant material axially from the nozzle and a plurality of circumferentially spaced holes spaced radially from the central orifice for dispersing suppressant material radially or at an angle from the tip of the nozzle.

The windows, central orifice, and holes are cooperatively positioned and sized for achieving a nearly hemispherical discharge pattern with little loss of dispersion velocity. For example, the open area of the central orifice is greater than the open area of each of the holes. Additionally, the holes are positioned so that they circumscribe the central orifice and are at an equal distance from the central orifice.

In preferred forms, the sum of the open areas of the central orifice and the holes is at least fifteen percent of the sum of the open areas of all the windows. Additionally, the sum of the open areas of the central orifice, all the holes, and all the windows is at least double the cross sectional area of the hollow passageway of the nozzle leading to the central orifice, surrounding holes and discharge windows.

By constructing an explosion suppressant dispersion nozzle as described herein, numerous advantages are realized. For example, by constructing an explosion suppressant dispersion nozzle in accordance with the above-recited dimensional parameters, the nozzle unexpectedly achieves a nearly hemispherical suppressant discharge pattern. Thus, the nozzle disperses substantially equal amounts of suppressant to points which are generally equidistant from the nozzle at essentially the same time. This provides the most effective suppression of an explosion no matter where it occurs in the protected zone thereby eliminating the need to overlap nozzles in a protected zone to the extent previously required, thereby sufficiently reducing the cost of the explosion suppression system. This cost saving is amplified by virtue of the fact that it is not just a case where more nozzles are required to provide adequate nozzle pattern overlap, there must be an entire suppression unit supplied for each nozzle position.

Additionally, by constructing the side discharge windows with end walls that are semi-cylindrical in configuration and coaxial with the body section, the discharge rate of the suppressant is not excessively diminished as it exits the windows. This also allows the nozzle to more uniformly disperse the suppressant and to deliver the suppressant to areas remote from the nozzle.

It is also to be appreciated that although the improved suppressant discharge nozzle of this invention has been found to be especially useful for explosion suppression applications, it also has utility in fire protection systems because as explained, more uniform delivery of suppressant is realized, which necessarily is also a desirable attribute for fire suppression equipment. Furthermore, where an explosion is detected requiring immediate suppressant response, fast and efficient delivery of the suppressant to the sites of the incipient explosion will tend to also extinguish any associated fast fires. Similarly, in the case of a fire only, uniform and early delivery of suppressant on to the fire is important in preventing spread of the fire.

BRIEF DESCRIPTION OF THE DRAWING FIGURES

A preferred embodiment of the present invention is described in detail below with reference to the attached drawing figures, wherein.

Figure 4:
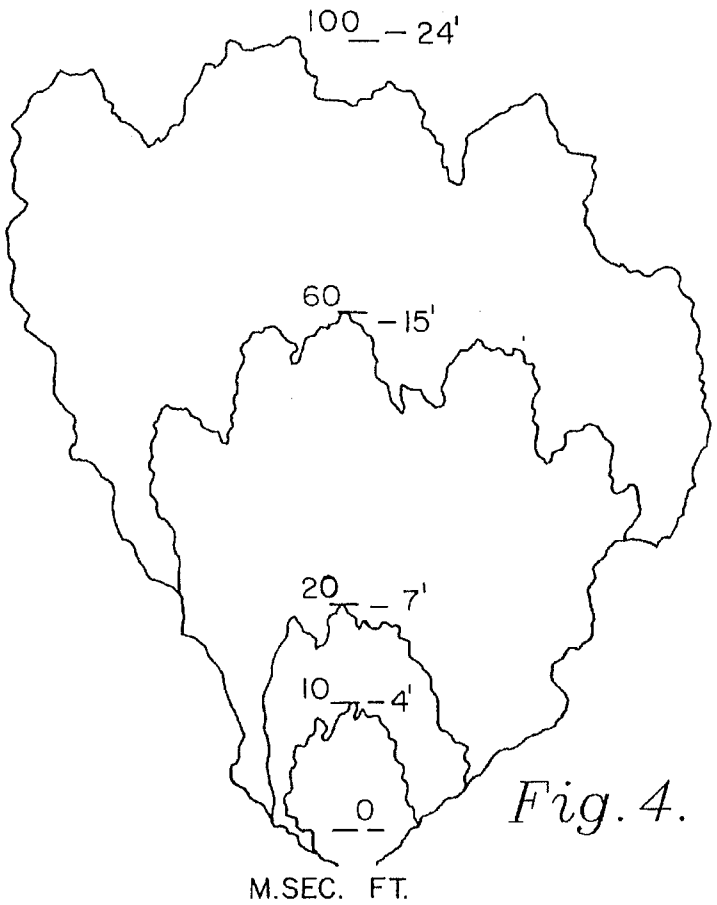
Figure 3:
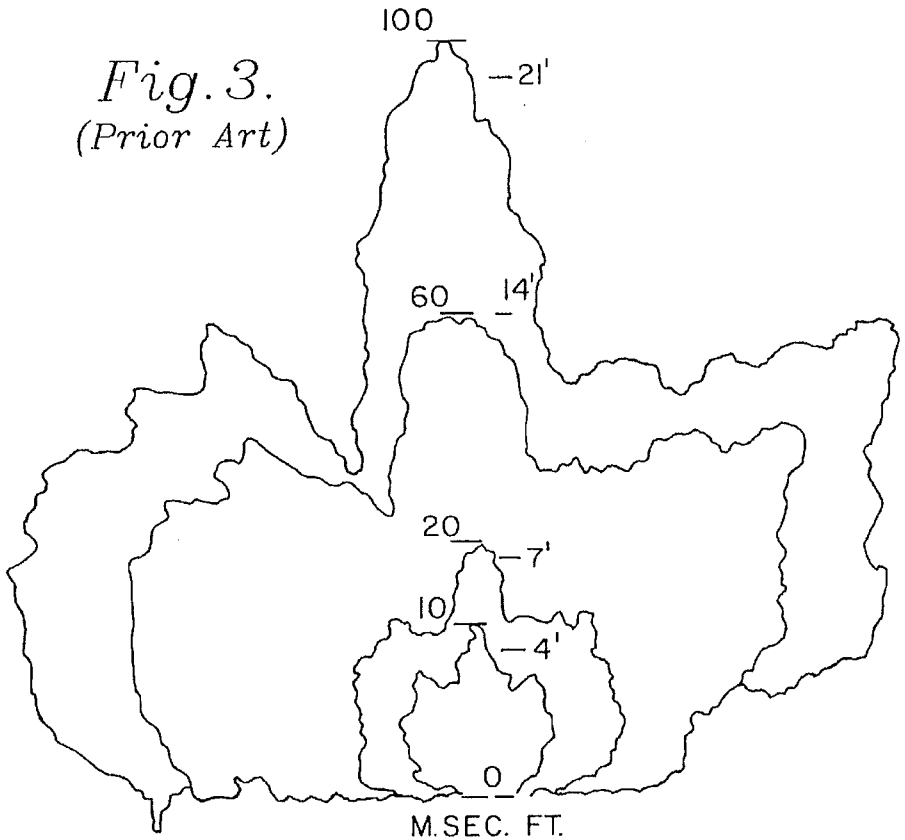
Fig. 3. (Prior Art)

FIG. 3 is a graphical representation of the discharge patterns for a prior art explosion suppression dispersion nozzle at time intervals of 10, 20, 60, and 100 milliseconds from the initial discharge of a suppressant vessel; and FIG. 4 is a graphical representation of the discharge patterns for the explosion suppression dispersion nozzle of the present invention at time intervals of 10, 20, 60, and 100 milliseconds from the initial discharge of the suppressant vessel.

DETAILED DESCRIPTION OF A PREFERRED EMBODIMENT

Figures 1, 2:
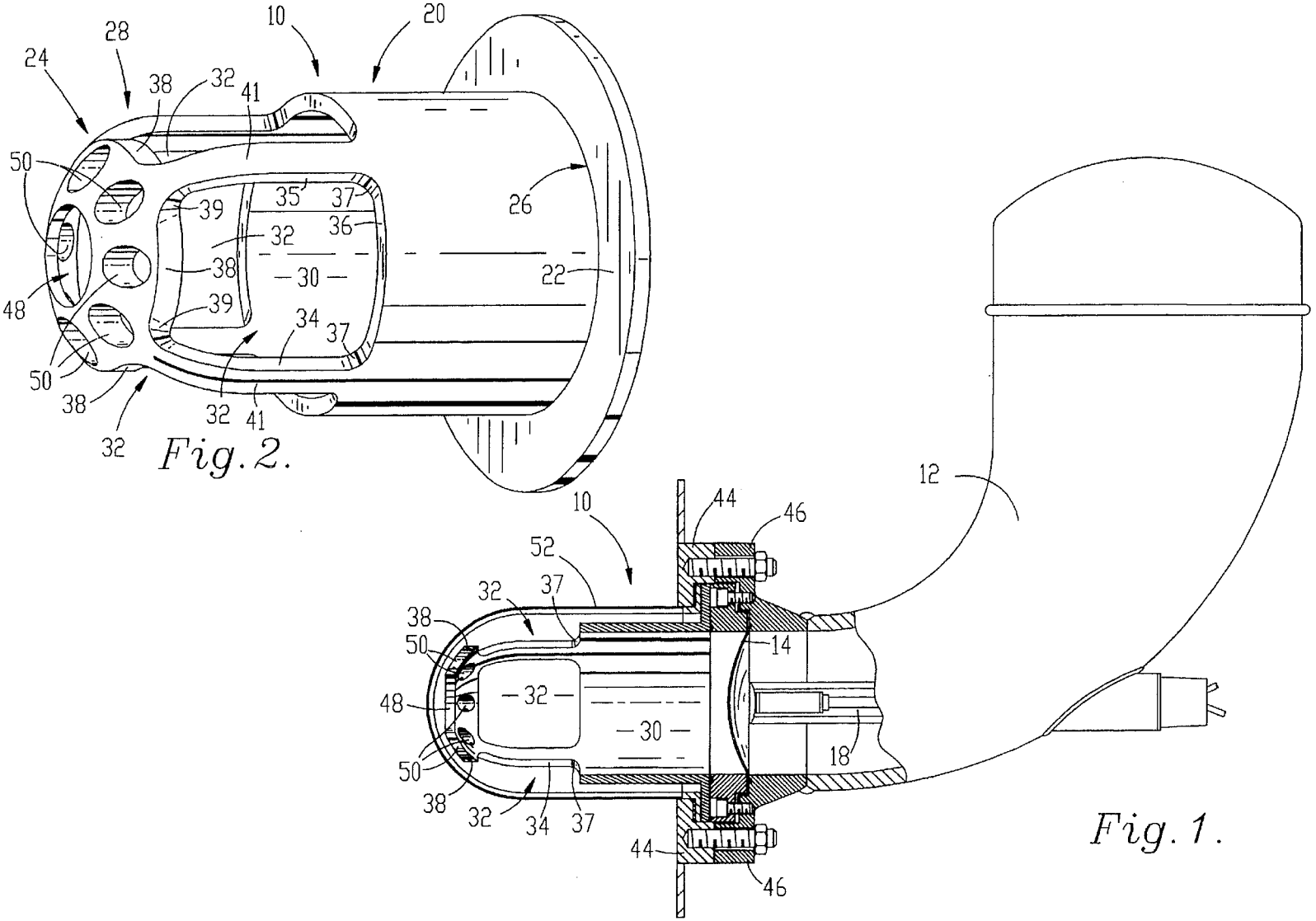
FIG. 1 is a side elevational view of an explosion protection system constructed in accordance with a preferred embodiment of the present invention showing the explosion suppression dispersion nozzle in section.
FIG. 2 is a perspective view of the explosion suppression dispersion nozzle.

Turning now to FIG. 2, an explosion suppressant dispersion nozzle 10 constructed in accordance with a preferred embodiment of the invention is illustrated. As illustrated in FIG. 1, the explosion suppressant dispersion nozzle 10 is preferably used in an explosion protection system including one or more suppressant storage vessels 12 spaced throughout a protected zone. An example of a preferred explosion protection system is disclosed in referenced U.S. Pat. No. 5,031,701.

In general, each storage vessel 12 contains a supply of pressurized suppressant material such as halogenated hydrocarbon,(e.g., Du Pont's Halon 1301 or 1211, Du Pont FE13, or Great Lakes FM 200), a powder, (e.g., sodium or potassium bicarbonate or monoamonium phosphate), water or other suitable material. Each storage vessel 12 is equipped with a rupture disc 14 disposed between the discharge end 28 of the storage vessel 12 and the nozzle 10 for hermetically sealing the pressurized suppressant material in the storage vessel 12. The explosion-protection system also typically includes a sensor device (not shown) such as a pressure sensitive device, or an infrared detector for sensing the presence of an explosion in the protected zone, a control device (not shown) responsive to the sensor device for generating electrical control signals when an explosion is detected, and an initiator or detonator 18 that is electrically responsive to current from the control device for initiating rupture of the rupture disc 14 in response to the detection of an incipient explosion in the protected zone. When the rupture disc 14 is actuated, the suppressant material flows out of the storage vessel 12 under pressure to the nozzle 10 for dispersion in the protected zone.

Returning to FIG. 2, the preferred explosion suppressant dispersion nozzle 10 broadly includes a cylindrical body section 20, an annular flange section 22, and a concavo-convex cap section 24. The sections 20,22,24 may be formed of stainless steel or other suitable material and are preferably integrally formed.

In more detail, the body section 20 of nozzle 10 presents an inlet end 26 for attachment to the proximate discharge end of the storage vessel 12 and a discharge end 28 axially spaced from the inlet end 26. A hollow passageway 30 extends between the inlet and discharge ends 26,28 for directing suppressant material from the pressurized suppressant vessel.

The body section 20 includes four circumferentially spaced windows 32 presenting generally rectangular openings for allowing suppressant material to flow laterally or radially outwardly from the passageway 30 of the body section 20. Each of the windows 32 is defined by a pair of elongated, spaced, longitudinally extending sidewalls 34,35 which are parallel to the longitudinal axis of the passageway 30 and thereby essentially perpendicular to the outer surface of the body section 10.

A pair of opposed, elongated vanes 36,38 defining a part of each window 32 are perpendicular to opposed side walls 34,35 with end walls 36 being proximate to the inlet end 26 of the passageway 30. The end wall 38 of each window 32 is axially spaced from the corresponding vane 36 and is proximate to the discharge end 28 of the body section 20.

End walls 36 lie in an imaginary annulus with the transverse extent of each vane 36 being generally perpendicular to the axis of passageway 30. End walls 38 lie in an imaginary cylinder which is coaxial with the longitudinal axis of passageway 30, but of somewhat lesser diameter. As best illustrated in FIG. 1, the semi-cylindrical end walls 38 of each window 32 merge with interior concave surface of the cap section 24 to present a series of relatively sharp, semi-circular edges that are coaxial with the longitudinal axis of the passageway 30.

The effective size of the open area of each of the windows 32 is correlated with the volume of the suppressant in a particular suppressant vessel 12, the pressure within such vessel 12, the diameter of the outlet orifice of the vessel 12, the corresponding diameter of the passageway 30 of the nozzle 10, the length of the passageway 30, and the nature of the suppressant within the vessel 12. In one preferred embodiment of a nozzle 10 having an internal diameter of 6" and a passageway length of about 10", the sidewalls 34,35 are spaced approximately 3–4 inches apart and vanes 36 are spaced approximately 3–4 inches apart so that each window 32 presents an open area of approximately 9–16 square inches. The zones of merger 37 of each vane 36 with respective side walls 34,35 are of arcuate configuration as depicted in FIGS. 1 and 2. Similarly, the zones of merger 39 of each side wall 34,35 with respective end walls 38 are of arcuate shape. Window walls 41 forming a part of the body section 20 are located between the side walls 34,35 of adjacent windows 32.

As illustrated in FIG. 1, the vane 38 of each window 32 converges with the interior surface of the cap section 32 to present a relatively sharp edge. In preferred forms, the angle of convergence between the vane 38 of each window 32 and the interior concave surface of the cap section 24 is approximately 5–30 degrees and generally about 15 degrees. With this construction, the semi-cylindrical end walls 38 define relatively sharp edges at the zones of merger thereof with the interior concave surface of cap section 24 to offer relatively little disruptive resistance to flow of the suppressant material out of the windows 32. This results in a higher and more uniform suppressant discharge rate from the nozzle 10.

The annular flange section 22 of nozzle 10 extends radially outwardly from the inlet end 26 of the body section 20 and is provided for attaching the nozzle 10 to a mating flange 44,46 at the discharge end of the storage vessel 12. As best illustrated in FIG. 1, the annular flange section 22 is preferably clamped or bolted between a pair of clamp assemblies 44,46 which are in turn bolted to the flange 47 of the discharge end of the storage vessel 12.

The cap section 24 of nozzle 10 is an integral part of the discharge end 28 of the body section 20 and is preferably of concavo-convex configuration. The cap section 24 includes a central orifice 48 aligned with the longitudinal axis of the passageway 30 and has a series of holes 50 circumferentially spaced around the central orifice 48 and spaced radially from the central orifice 48. A preferred embodiment of nozzle 10 is provided with eight holes 50.

The central orifice 48 disperses suppressant material axially from the nozzle 10, and the holes 50 disperse suppressant material at an angle from the nozzle 10. As discussed above, the effective size of the open area of the central orifice 48 and each of the holes 50 is correlated with the volume of the suppressant in a particular suppressant vessel 12, the pressure within such vessel 12, the diameter of the outlet orifice of the vessel 12, the corresponding diameter of the passageway 30 of the nozzle 10, the length of the passageway 30, and the nature of the suppressant within the vessel 12. In one preferred embodiment of a nozzle 10 having an internal diameter of 6" and a passageway length of about 10", the central orifice 48 presents a diameter of approximately 2–2.5 inches, and therefore an area of approximately 3–5 square inches and each hole 50 presents a diameter of approximately 1–1.25 inches, and therefore an open area of approximately 0.8–1.2 square inches.

Advantageously, the windows 32, central orifice 48, and holes 50 are cooperatively positioned and sized for achieving a nearly hemispherical discharge pattern from the nozzle 10 with little loss of dispersion velocity. To achieve a hemispherical discharge pattern, the nozzle 10 is formed so that the open area of the central orifice 48 is greater than the open area of each hole 50, and is preferably approximately 3–4 times as large. Additionally, the holes 50 are positioned so that they circumscribe the central orifice 48 and are at an equal distance from the central orifice 48.

Additionally, the sum of the areas of the central orifice 48 and the holes 50 is at least fifteen percent of the combined area of the windows 32 and is preferably twenty-five percent of the combined area. Additionally, the sum of the areas of the central orifice 48, the holes 50, and the windows 32 is at least double the cross sectional area of the hollow passageway 32 of nozzle body 20 and is preferably approximately five times as great.

By constructing the nozzle 10 in accordance with the above-described parameters, a nearly hemispherical suppressant discharge pattern is achieved with little loss of discharge flow rate. FIG. 4 is a graphical representation of the discharge patterns for the present nozzle 10 at time intervals of 10, 20, 60, and 100 milliseconds from the time of the initial discharge of suppressant from vessel 12. The Figure illustrates the discharge pattern of a 6 inch diameter nozzle attached to a 25 liter storage vessel containing suppressant under 900 psi. The left legend indicates the time interval from the initial discharge, and the right legend indicates the distance traveled by the suppressant after discharge from the nozzle 10 during each time interval. As previously noted, FIG. 3 is a similar graphical representation of the discharge pattern of a prior art nozzle at the same time intervals and under similar operating parameters.

As illustrated in FIGS. 3 and 4, the nozzle 10 of the present invention achieves a nearly hemispherical discharge pattern, whereas the prior art nozzle has a discharge pattern that is heavily concentrated near the tips and immediate sides of the nozzle. Additionally, the nozzle 10 of the present invention disperses suppressant approximately 4, 7, 15, and 24 feet after 10, 20, 60, and 100 milliseconds, respectively, whereas the prior art nozzle disperses suppressant only 4, 7, 14, and 21 feet after 10, 20, 60, and 100 milliseconds, respectively.

The present explosion protection system may also include a cover unit 52 (see FIG. 1) that envelops the nozzle 10 for preventing the central orifice 48, holes 50 and windows 32 from becoming clogged when the nozzle 10 is not in use. The cover unit 52 is constructed to rupture when the suppressant is discharged from the storage vessel 12 for permitting suppressant to flow unimpeded from the nozzle 10. The preferred cover unit is disclosed in more detail in U.S. Pat. No. 5,199,500, which is hereby incorporated herein by reference thereto.

Although the invention has been described with specific reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A nozzle for attachment to a pressurized suppressant vessel for discharging suppressant material from the vessel, the nozzle comprising:

a cylindrical body section presenting an inlet end for attachment to the vessel, a discharge end axially spaced from the inlet end, and a hollow passageway extending between the inlet and discharge ends for delivering suppressant material from the pressurized suppressant vessel, the body section including a plurality of circumferentially spaced generally rectangular windows for dispersing the suppressant material laterally from the passageway, each of the windows presenting a first open area; and a cap section attached to the discharge end, the cap section including a central orifice aligned with the longitudinal axis of the nozzle for dispersing the suppressant material axially from the passageway, the central orifice presenting a second open area, and a plurality of circumferentially spaced holes spaced radially from the central orifice for dispersing the suppressant material radially from the passageway, each of the holes presenting a third open area, the second open area being greater than each of the third open areas.

2. The nozzle as set forth in claim 1, further including an annular flange section extending radially outwardly from the inlet end for attachment to the storage vessel.

3. The nozzle as set forth in claim 1, the sum of the second and third open areas being at least fifteen percent of the sum of the first open areas.

4. The nozzle as set forth in claim 1, the sum of the second and third open areas being at least twenty percent of the sum of the first open areas.

5. The nozzle as set forth in claim 1, the sum of the second and third open areas being approximately twenty five percent of the sum of the first open areas.

6. The nozzle as set forth in claim 1, the sum of the first, second and third open areas being at least double the cross sectional area of the hollow passageway of the cylindrical body section.

7. The nozzle as set forth in claim 1, each of the open windows presenting a first end wall proximate the inlet end of the body section and a second end wall axially spaced from the first end wall and proximate the discharge end of the body section, each of the second end walls being semi-cylindrical in configuration and coaxial with the longitudinal axis of the passageway for reducing the flow resistance of the open windows.

8. The nozzle as set forth in claim 7, the cap section presenting an interior concave surface, wherein the second end walls of the open windows merge with the interior concave surface of the cap section to present a series of sharp, semi-circular edges that are coaxial with the longitudinal axis of the passageway.

9. The nozzle as set forth in claim 8, wherein the second end wall of each open window and the interior surface of the cap section converge towards one another at an angle of convergence of less than sixty degrees.

10. The nozzle as set forth in claim 9, the angle of convergence between the second end wall of each open window and the interior surface of the cap section being less than thirty degrees.

11. An explosion protection apparatus for discharging a suppressant material into a zone for preventing and extinguishing explosions in the zone, the apparatus comprising:

a storage vessel for storing a supply of pressurized suppressant material;

a rupture disc for sealing the pressurized suppressant material in the storage vessel;

sensor means for sensing the presence of an incipient explosion in the protected zone;

rupturing means responsive to the sensor means for rupturing the rupture disc in response to the sensing of the explosion for allowing the suppressant material to escape the storage vessel; and a nozzle coupled with the storage vessel for dispersing the suppressant material throughout, the nozzle including a cylindrical body section presenting axially spaced inlet and discharge ends, the body section including a plurality of circumferentially spaced windows for dispersing the suppressant material laterally from the nozzle, each of the windows presenting a first open area, and a cap section attached to the discharge end, the cap section including a central orifice aligned with the longitudinal axis of the nozzle for dispersing the suppressant material axially from the nozzle, the central orifice presenting a second open area, and a plurality of circumferentially spaced holes spaced radially from the central orifice for dispersing the suppressant material radially from the passageway, each of the holes presenting a third open area, the second open area being greater than each of the third open areas.

12. The apparatus as set forth in claim 11, the nozzle further including an annular flange section extending radially outwardly from the inlet end for attachment to the storage vessel.

13. The nozzle as set forth in claim 11, the sum of the second and third open areas being at least fifteen percent of the sum of the first open areas.

14. The nozzle as set forth in claim 11, the sum of the second and third open areas being at least twenty percent of the sum of the first open areas.

15. The nozzle as set forth in claim 11, the sum of the second and third open areas being about twenty five percent of the sum of the first open areas.

16. The nozzle as set forth in claim 11, the sum of the first, second and third open areas being at least double the cross sectional area of the hollow passageway of the cylindrical body section.

17. The nozzle as set forth in claim 11, each of the open windows presenting a first end wall proximate the inlet end of the body section and a second end wall axially spaced from the first end wall and proximate the discharge end of the body section, each of the second end walls being semi-cylindrical in configuration and coaxial with the longitudinal axis of the passageway for reducing the flow resistance of the open windows.

18. The nozzle as set forth in claim 17, the cap section presenting an interior concave surface, wherein the second end walls of the open windows merge with the interior concave surface of the cap section to present a series of sharp, semi-circular edges that are coaxial with the longitudinal axis of the passageway.

19. The nozzle as set forth in claim 18, wherein the second end wall of each open window and the interior surface of the cap section converge towards one another at an angle of convergence of less than sixty degrees.

20. The nozzle as set forth in claim 19, the angle of convergence between the second end wall of each open window and the interior surface of the cap section being less than thirty degrees.

* * * * *